United States Patent [19]

Notter

[11] 4,452,282

[45] Jun. 5, 1984

[54] SYSTEM FOR MOUNTING HARNESS FRAMES IN A WEAVING LOOM

[75] Inventor: Arsène Notter, Mulhouse, France

[73] Assignee: Societe Alsacienne de Construction Mecaniques de Mulhouse, France

[21] Appl. No.: 365,276

[22] Filed: Apr. 5, 1982

[30] Foreign Application Priority Data

Apr. 15, 1981 [FR] France ..... 81 07581

[51] Int. Cl.[3] ..... D03C 13/00

[52] U.S. Cl. ..... 139/88

[58] Field of Search ..... 139/57, 82, 83, 88; 24/255 R, 256, 11 C, 3 J, 3 L

[56] References Cited

U.S. PATENT DOCUMENTS 3,779,287 12/1973 Palau ..... 139/88

FOREIGN PATENT DOCUMENTS 2201812 1/1972 Fed. Rep. of Germany ..... 139/57
1160622 11/1956 France ..... 139/57
2408672 7/1979 France ..... 139/57
2056507 7/1980 United Kingdom ..... 139/88

*Primary Examiner*—Henry Jaudon
*Assistant Examiner*—Tracy Graveline
*Attorney, Agent, or Firm*—George H. Gerstman

[57] ABSTRACT

In a weaving loom, the harness frames are coupled by means of two link-arms to rockers which are actuated by the shedding mechanism. The head of each link-arm is provided with a recess in which is inserted a stub-shaft carried by each harness frame, the stub-shaft shaft being held in position by means of a spring carried by the link-arm head. High-speed looms can thus be equipped with lightweight frames of smaller thickness which can be mounted with greater ease.

7 Claims, 6 Drawing Figures

SYSTEM FOR MOUNTING HARNESS FRAMES IN A WEAVING LOOM

This invention relates to the textile industry and more particularly to the field of weaving.

It is known that, in all types of weaving looms, a certain number of harness frames are provided for the purpose of forming the shed. Harness frames are placed in parallel relation in vertical planes and subjected by means of levers and rockers to a rectilinear back-and-forth movement between a top position and a bottom position under the action of the shedding mechanism. Coupling of each harness frame to the lever which is actuated by the shedding mechanism is achieved by means of a member secured by means of a screw which has to be tightened hard up. This member, however, is located between the base of the frames and the foot of the loom in a region which is not readily accessible. Positioning of a set of frames is therefore an operation which requires time to be performed correctly. Furthermore, the fastening member occupies a substantial width (of the order of one and a half centimeters) which is unacceptable in the case of the narrow frames employed in high-speed looms.

The aim of the invention is to overcome the disadvantages mentioned in the foregoing by providing a system for mounting the harness frames of a weaving loom on the rockers which are driven in oscillating motion by the shedding mechanism. Said system essentially comprises a link-arm, the lower end of said link-arm being rigidly fixed to the rockers aforesaid and the link-arm head being provided with a semi-circular recess in which is inserted a stub-shaft carried by the harness frame, said stub-shaft being held in position by means of a spring carried by the link-arm head.

The spring aforesaid extends opposite to flared-out portions which form extensions of the aforesaid semi-circular recess.

These and other features of the invention will be more apparent to those skilled in the art upon consideration of the following description and accompanying drawings, wherein.

Figure 4:
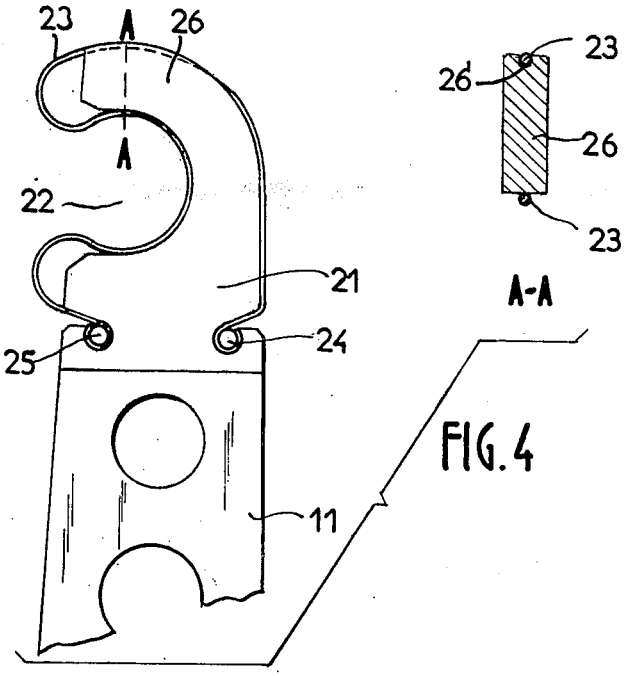
Figure 3A:
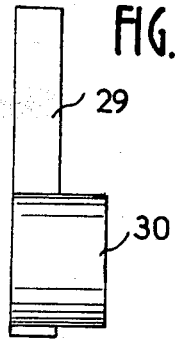
Figure 3B:
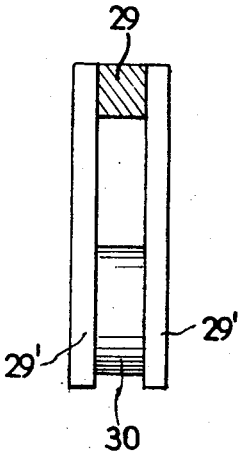
Figure 5:
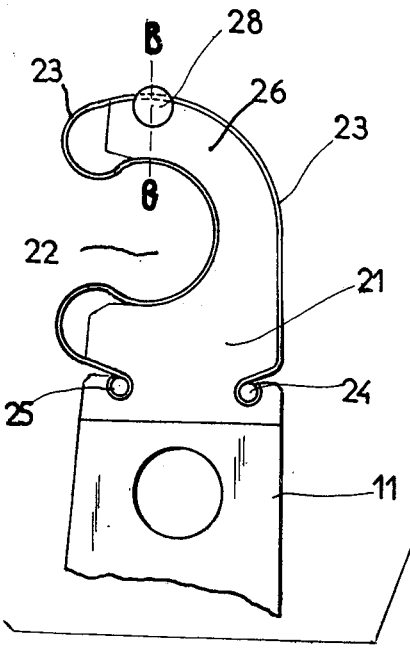
Figure 5:
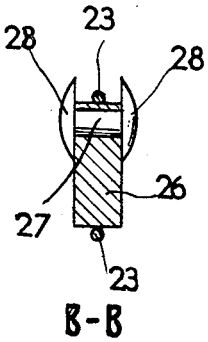

FIGS. 3A and 3B relate to the arrangement of the stub-shafts which are attached to the harness frame;

FIGS. 4 and 5 illustrate means for maintaining the spring in position on the link-arm.

Figure 1:
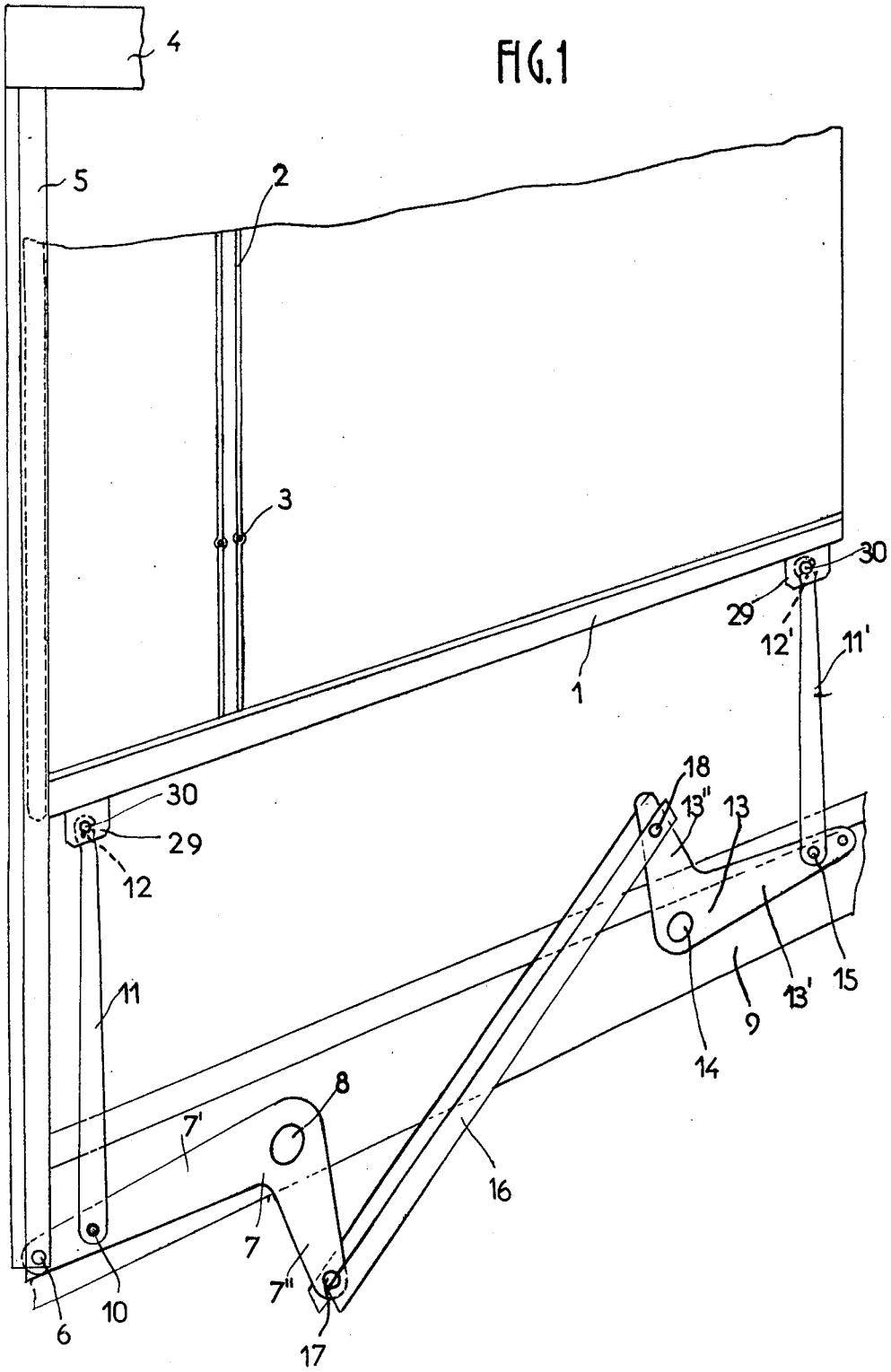
FIG. 1 is a view of a frame mounted according to the invention.

The perspective view of FIG. 1 shows a harness frame 1 for carrying heddles 2 provided with eyes 3 through which the warp threads (not shown) are passed. Said frame is driven in reciprocating motion in the vertical direction under the action of the shedding mechanism 4. In accordance with known practice, the shedding mechanism actuates a rod 5 which is pivotally attached at 6 to the end of the arm 7′ of a bell-crank lever 7 which will be designated hereinafter as a rocker. Said rocker is capable of displacement in oscillating motion about a fulcrum-pin 8 which is rigidly fixed to a beam 9, said beam being attached to the frame of the loom. In addition, one end of a link-arm 11 designed according to the invention is pivotally attached to the rocker arm 7′ at 10; the other end or head 12 of said link-arm 11 can be coupled to the harness frame 1 in a manner which will be described hereinafter. A second bell-crank lever or rocker 13 which is identical with the rocker 11 is capable of displacement in oscillating motion about a fulcrum-pin 14 which is also rigidly fixed to the beam 9. The positions of the rockers 13 and 7 are symmetrical with respect to the mid-point of the straight line which joins the ends of the fulcrum-pins 8 and 14. A second link-arm 11′ is pivotally attached at 15 to the arm 13′ of the rocker 13 and 12′ to the harness frame 1. The two link-arms 11—11′ are disposed symmetrically with respect to the vertical axis of the frame 1. The arms 7″ and 13″ of the rockers 7 and 13 are coupled together by means of a bar 16, one end of which is pivotally attached to the arm 7″ at 17 whilst the other end is pivotally attached to the arm 13″ at 18.

Figure 2:
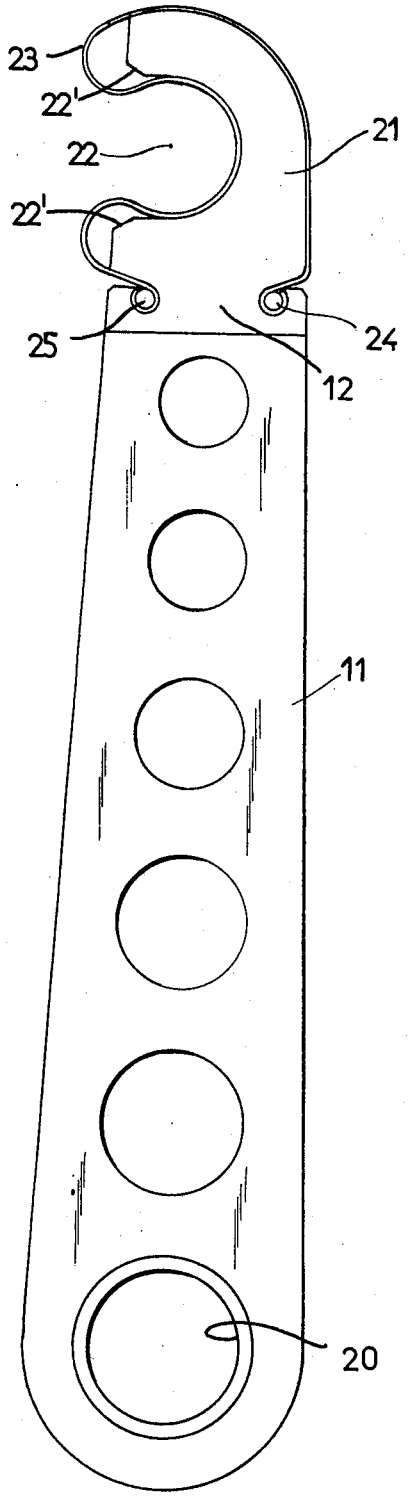
FIG. 2 illustrates a link-arm of the mounting system according to the invention.

Lightweight construction of the link-arms 11 and 11′ is ensured by forming a number of openings in each link-arm body, as shown in FIG. 2. The lower end of the body is pierced by a hole 20 for attaching the link-arm in any known manner to one of the arms of a rocker of the type designated by the reference numeral 7 in FIG. 1. The other end of the link-arm has a head 21 in which is formed a cut-out portion or recess 22, the bottom of which is of semi-circular shape and the front side of which is extended by two outwardly flared portions 22′—22′.

A spring 23 is attached to the link-arm head and extends opposite to the flared-out portions 22′—22′.

Preferably, the spring 23 is composed of a spring wire which closely conforms to the external shape of the link-arm head as shown in FIG. 2. The ends of said spring are attached to the head by means of two rivets 24—25, for example.

In another embodiment shown in FIG. 4, the top portion 26 of the link-arm head 21 is cut so as to form a groove 26′ in which the wire of spring 23 is inserted.

In another embodiment illustrated in FIG. 5, a rivet 27 passes through the top portion of the link-arm head 21 and the rivet heads 28 constitute two side-plates which hold the wire of spring 23 in position.

As shown in FIGS. 1 and 3, each harness frame 1 is provided at the lower end with two lugs 29. Each lug is adapted to carry a horizontal stub-shaft which has a circular cross-section and is substantially equal in diameter to the bottom portion 22 of the recess formed in the head 21 of the link-arm 11. The lug 29 can simply provide a cantilever support for the stub-shaft 30 as shown in FIG. 3A or can constitute a support bracket for holding each end of the stub-shaft 30 between cheeks 29′, as shown in FIG. 3B.

The operation of the system takes place as follows:

The rockers 7 and 13 are placed in position once and for all in known manner on their respective fulcrum-pins 8 and 14. As will readily be apparent, provision is made in each group for a number of pairs of rockers corresponding to the number of harness frames 1 on the loom. As stated earlier, the rods 16 and the lower ends of the link-arms 11 are attached to the rockers and the same applies to the rods 5 which are coupled to the shedding mechanism 4.

At the time of placing in position, a set of harness frames is first introduced in the usual manner. In order to couple each frame, it is then only necessary to place the opening of the link-arm head opposite to the corresponding stub-shaft 30 and to exert a thrust on the link-arm by hand, thereby causing expansion of the spring 23 by virtue of the flared-out portion of the opening. By reason of its shape, said opening fits closely around the stub-shaft 30 which is thus imprisoned within the link-arm head when the spring 23 has reverted to its initial position. This mode of assembly is both rapid and easy, without entailing the need for any tool. The operator works next to the machine at the level of the base of the frames or in other words at a relatively accessible location, thus making the frame-positioning operation much easier and less time-consuming than was the case in the past. Furthermore, the invention permits a reduction in overall thickness of the harness frames in comparison with conventional mounting systems. Since it is a desirable objective to have narrow harness frames in high-speed looms, this accordingly represents an appreciable advantage.

What is claimed is:

1. A system for mounting the harness frames of a weaving loom on the rockers which are driven in oscillating motion by the shedding mechanism, comprising a link-arm, the lower arm of said link-arm being pivotally connected to the rockers aforesaid and the link-arm head being detachably coupled to the harness frames, wherein the link-arm head is provided with a semi-circular recess comprising an opening which is defined by an outwardly-flared portion of the link-arm head, and in which recess there may be inserted a stub-shaft having a circular cross-section and carried by the harness frame, and wherein said link-arm head carries a spring within the recess which serves to retain said stub-shaft and is spaced from but adjacent said outwardly-flared portion.

2. A system according to claim 1, wherein the spring comprises a wire which surrounds the link-arm head as well as the semi-circular bottom portion of the head recess, the ends of said spring being attached to said head.

3. A system according to claim 2, wherein the spring is held in position within a groove cut at the top portion of the link-arm head.

4. A system according to claim 2, wherein the spring is held is position between the heads of a rivet which extends through the top portion of the link-arm head.

5. A system according to claim 1, wherein the stub-shaft is mounted as a cantilever on a supporting lug which is rigidly fixed to the base of the harness frame.

6. A system according to claim 1, wherein the stub-shaft is tightly held within a yoke forming part of a support bracket which is rigidly fixed to the base of the harness frame.

7. A system according to claim 1, in which said opening is defined by two outwardly-flared portions and in which said spring is spaced from but adjacent said two outwardly-flared portions.

* * * * *